US011631382B2

(12) United States Patent
Bae et al.

(10) Patent No.: US 11,631,382 B2
(45) Date of Patent: Apr. 18, 2023

(54) ELECTRONIC DEVICE FOR CONTROLLING DISPLAY POSITION OR AREA OF IMAGE ON BASIS OF CHANGE OF CONTENT OF IMAGE

(71) Applicant: SAMSUNG ELECTRONICS CO., LTD., Suwon-si (KR)

(72) Inventors: Jongkon Bae, Suwon-si (KR); Hanyuool Kim, Suwon-si (KR); Donghwy Kim, Suwon-si (KR); Hojin Kim, Suwon-si (KR); Hyunjun Park, Suwon-si (KR); Yohan Lee, Suwon-si (KR); Hongkook Lee, Suwon-si (KR); Dongkyoon Han, Suwon-si (KR); Yunpyo Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/282,270

(22) PCT Filed: Nov. 1, 2019

(86) PCT No.: PCT/KR2019/014671
§ 371 (c)(1),
(2) Date: Apr. 1, 2021

(87) PCT Pub. No.: WO2020/091491
PCT Pub. Date: May 7, 2020

(65) Prior Publication Data

US 2021/0375239 A1 Dec. 2, 2021

(30) Foreign Application Priority Data

Nov. 1, 2018 (KR) ..... 10-2018-0133117

(51) Int. Cl.
*G09G 5/38* (2006.01)
*G09G 3/00* (2006.01)

(52) U.S. Cl.
CPC ..... *G09G 5/38* (2013.01); *G09G 3/00* (2013.01); *G09G 3/007* (2013.01);
(Continued)

(58) Field of Classification Search
CPC ..... G09G 2340/0464; G09G 2340/045; G09G 2320/046; G09G 3/007; G09G 5/38; G09G 5/373; G09G 3/00
See application file for complete search history.

(56) References Cited

U.S. PATENT DOCUMENTS

2001/0030657 A1* 10/2001 Hamon ..... G06F 3/1475 345/660
2002/0097324 A1* 7/2002 Onuki ..... H04N 5/23254 348/208.99

(Continued)

FOREIGN PATENT DOCUMENTS

EP 1503360 2/2005
EP 1 847 978 10/2007

(Continued)

OTHER PUBLICATIONS

International Search Report for PCT/KR2019/014671 dated Feb. 27, 2020, 5 pages.

(Continued)

*Primary Examiner* — Abbas I Abdulselam
(74) *Attorney, Agent, or Firm* — Nixon & Vanderhye, P.C.

(57) ABSTRACT

An electronic device is disclosed that includes a display, a display driver IC that drives the display, and at least one processor operationally connected with the display and the display driver IC. The display driver IC moves a display (Continued)

location of one or more pixel data corresponding to an image associated with at least one application from a specified point by a specified distance on an active area of the display. The at least one processor is configured to scale up a first portion of the image by a specified range based on the specified distance, scale down a second portion of the image by the specified range based on the specified distance, and display the image on the active area based on the scaled-up first portion or the scaled-down second portion. In addition, various embodiments recognized through the specification are possible.

15 Claims, 16 Drawing Sheets

(52) U.S. Cl.
CPC . *G09G 2320/046* (2013.01); *G09G 2340/045* (2013.01); *G09G 2340/0464* (2013.01)

(56) References Cited

U.S. PATENT DOCUMENTS

| | | | | |
|---|---|---|---|---|
| 2004/0057619 | A1* | 3/2004 | Lim | G06K 9/033 382/182 |
| 2005/0018046 | A1 | 1/2005 | Tsuzuki | |
| 2005/0244050 | A1* | 11/2005 | Nomura | H04N 13/398 382/154 |
| 2006/0061658 | A1* | 3/2006 | Faulkner | H04N 5/23254 348/207.1 |
| 2008/0238944 | A1 | 10/2008 | Sugimoto et al. | |
| 2012/0075438 | A1 | 3/2012 | Kikkawa | |
| 2012/0188245 | A1* | 7/2012 | Hyatt | G09G 3/007 345/428 |
| 2013/0321361 | A1 | 12/2013 | Lynch et al. | |
| 2016/0111034 | A1 | 4/2016 | Lee et al. | |
| 2016/0321974 | A1 | 11/2016 | Chun et al. | |
| 2016/0329008 | A1 | 11/2016 | Chun et al. | |
| 2017/0200257 | A1 | 7/2017 | Van Den Herik et al. | |
| 2018/0025468 | A1 | 1/2018 | Kim et al. | |
| 2018/0281309 | A1* | 10/2018 | Herrmann | B41J 3/4073 |
| 2020/0090301 | A1 | 3/2020 | Kim et al. | |
| 2020/0302843 | A1 | 9/2020 | Chun et al. | |

FOREIGN PATENT DOCUMENTS

| | | |
|---|---|---|
| EP | 3089146 | 11/2016 |
| EP | 3091530 | 11/2016 |
| JP | 4059106 | 3/2008 |
| KR | 10-2007-0048852 | 5/2007 |
| KR | 10-2016-0132170 | 11/2016 |
| KR | 10-2018-0033389 | 4/2018 |
| WO | 2010/140430 | 12/2010 |

OTHER PUBLICATIONS

Written Opinion of the ISA for PCT/KR2019/014671 dated Feb. 27, 2020, 4 pages.
Extended Search Report dated Mar. 25, 2022 in EP Application No. 19880559.0.
Communication pursuant to Rule 164(1) dated Jan. 18, 2022 in EP Application No. 19880559.0.
Examination Report dated Feb. 10, 2022 in IN Application No. 202117016771 and English-language translation.
Office Action dated Oct. 28, 2022 Korean Application No. 10-2018-0133117 and English-language translation.

* cited by examiner

ELECTRONIC DEVICE FOR CONTROLLING DISPLAY POSITION OR AREA OF IMAGE ON BASIS OF CHANGE OF CONTENT OF IMAGE

This application is the U.S. national phase of International Application No. PCT/KR2019/014671 filed Nov. 1, 2019 which designated the U.S. and claims priority to KR Patent Application No. 10-2018-0133117 filed Nov. 1, 2018, the entire contents of each of which are hereby incorporated by reference.

FIELD

Embodiments disclosed in the disclosure relate to technologies of adjusting an area while moving a location of content of an image associated with an application displayed on a display and preventing degradation generated by displaying the same running screen for a long time.

DESCRIPTION OF RELATED ART

An electronic device may include a display displaying an image associated with an application. The image may include a variety of content depending on a type or an operation state of an application which is running. The content of the image may be displayed while moving and may be displayed on a certain location for a long time. When content maintains a certain location, the display may display a certain screen.

Meanwhile, when a display panel such as an organic light emitting diode (OLED) panel displays a certain screen for a long time, the display displaying the image may be degraded and an afterimage may occur. When degradation or burn-in occurs in a light emitting element making up a pixel of the display, the luminance of the pixel may be degraded to result in uniformity of image representation.

SUMMARY

To prevent degradation of a display, when displaying a certain image for a long time, an electronic device may scale down the image and may display the image while moving the screen. However, in this case, problems, in which the image becomes small in size, movement of the image is visible to a user, and the image leans to one side, occur.

Alternatively, to prevent the degradation of the display, when displaying a certain image for a long time, the electronic device may mask an edge area and may output the image while moving the image. However, In this case, a problem in which content displayed on the edge area of the image is cropped according to movement of the image occurs.

Embodiments disclosed in the disclosure are to provide an electronic device for addressing the above-mentioned problems or problems raised in the disclosure.

In accordance with an aspect of the disclosure, an electronic device is provided. The electronic device may include a display, a display driver IC configured to drive the display, and at least one processor operationally connected with the display and the display driver IC. The display driver IC may move a display location of one or more pixel data corresponding to an image associated with at least one application from a specified point by a specified distance on an active area of the display. The at least one processor may be configured to scale up a first portion of the image by a specified range based on the specified distance, scale down a second portion of the image by the specified range based on the specified distance, and display the image on the active area based on the scaled-up first portion or the scaled-down second portion.

In accordance with another aspect of the disclosure, an electronic device is provided. The electronic device may include a display, a display driver IC configured to drive the display, and at least one processor operationally connected with the display and the display driver IC. The display driver IC may move a display location of one or more pixel data corresponding to an image associated with at least one application depending on a plurality of parameters by a specified distance on an active area of the display. The at least one processor may be configured to scale up a first portion of the image by a specified range based on the specified distance, scale down a second portion of the image by the specified range based on the specified distance, and display the image on the active area based on the scaled-up first portion or the scaled-down second portion.

In accordance with another aspect of the disclosure, an electronic device is provided. The electronic device may include a display, a display driver IC configured to drive the display, and at least one processor operationally connected with the display and the display driver IC. The display driver IC may move a display location of one or more pixel data corresponding to an image associated with at least one application at a specified time interval on an active area of the display. The at least one processor may be configured to scale up a range of a first portion of the image, when the display location of the pixel data moves, scale down a range of a second portion of the image by the scaled-up range of the first portion, and display the image on the active area based on the scaled-up first portion or the scaled-down second portion.

According to embodiments disclosed in the disclosure, the disclosure may prevent degradation of the display without representing that content of the image moves to the user.

Furthermore, according to embodiments disclosed in the disclosure, the image displayed on the display may be displayed in an intact state without leaning to one side or being cropped.

In addition, various effects ascertained directly or indirectly through the disclosure may be provided.

With regard to description of drawings, the same or similar denotations may be used for the same or similar components.

DETAILED DESCRIPTION OF EXAMPLE EMBODIMENTS

Hereinafter, various embodiments of the disclosure may be described with reference to accompanying drawings. However, it should be understood that this is not intended to limit the present disclosure to specific implementation forms and includes various modifications, equivalents, and/or alternatives of embodiments of the present disclosure.

Figure 1:
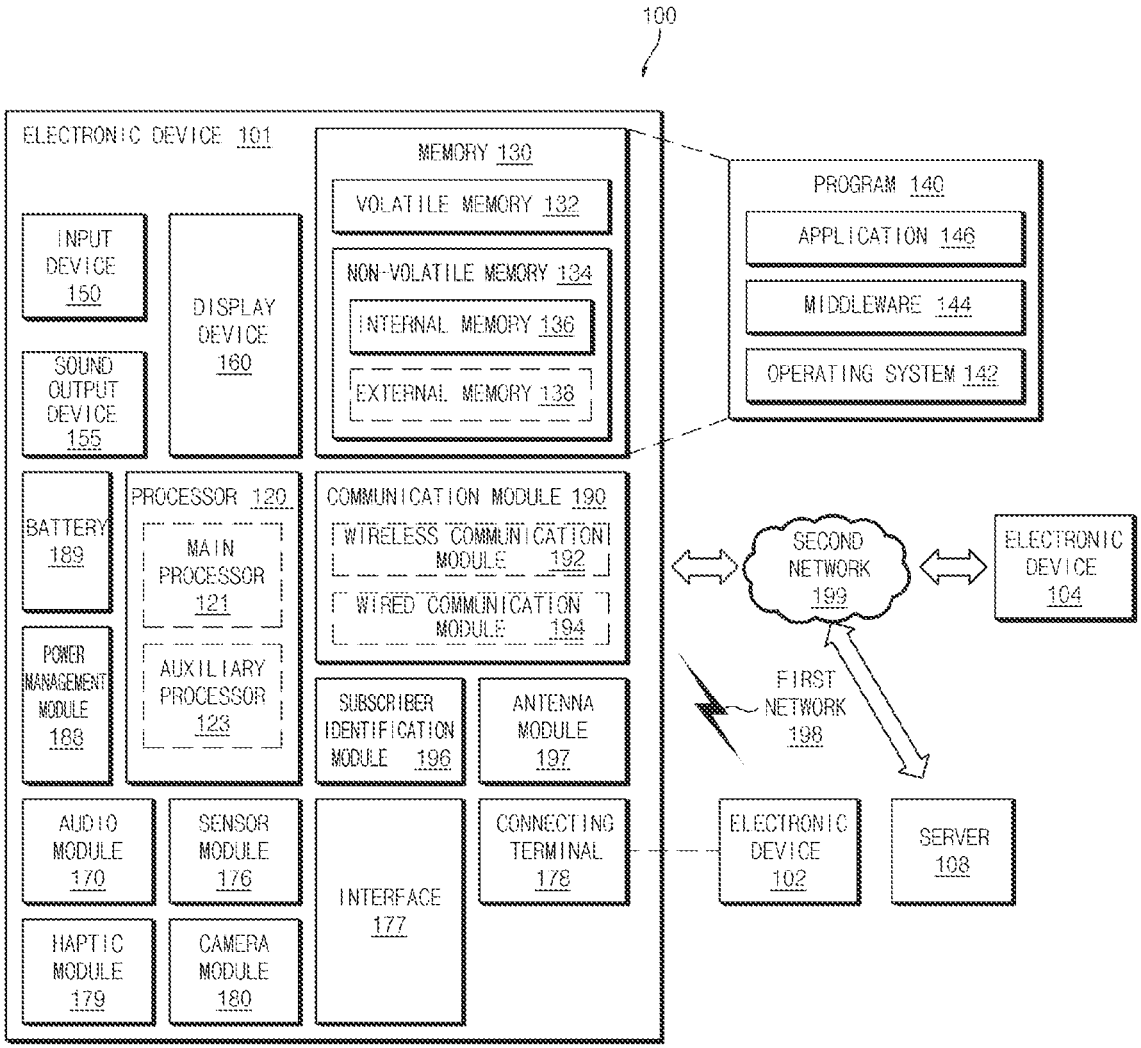
FIG. 1 is a block diagram illustrating an electronic device, controlling position or area of image based on a change of contents of image, in a network environment according to various embodiments.

FIG. 1 is a block diagram illustrating an electronic device 101, controlling position or area of image based on a change of contents of image, in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
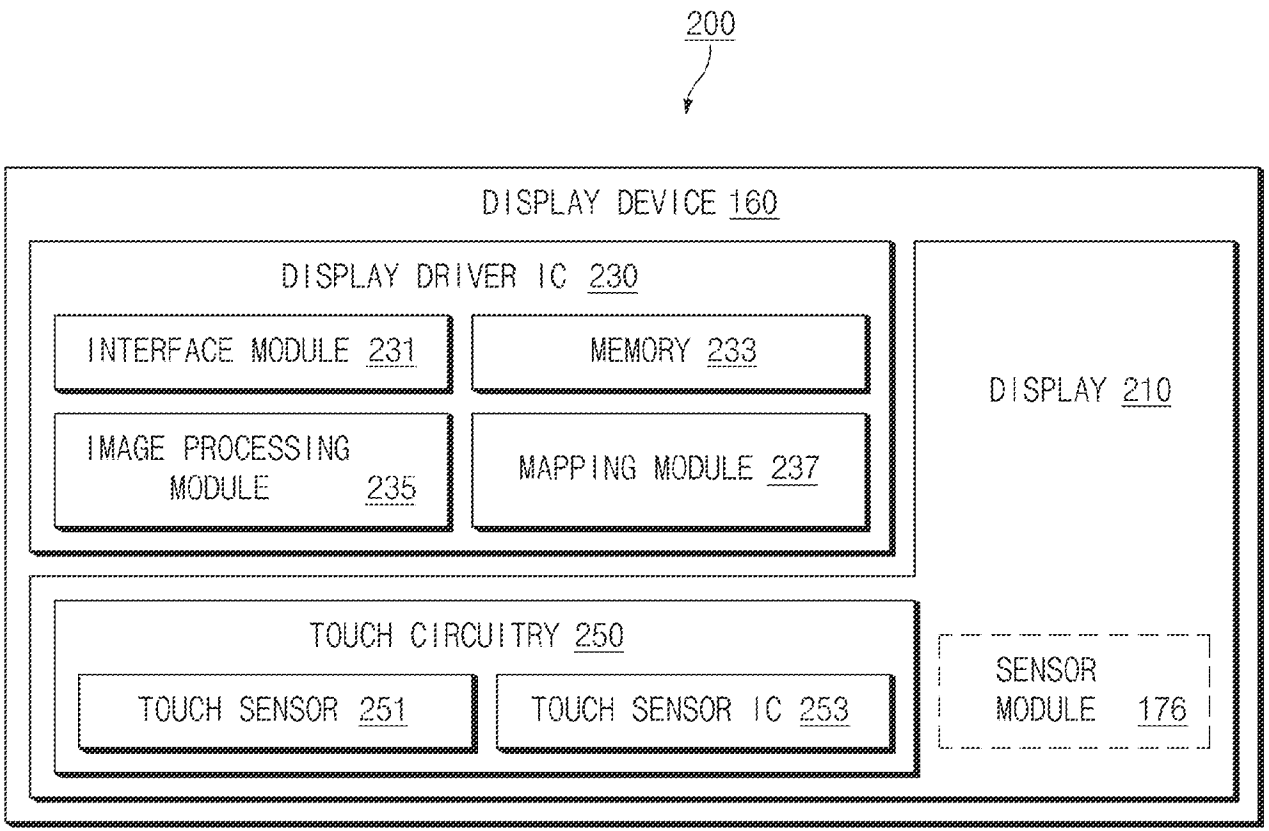
FIG. 2 is a block diagram illustrating the display device, controlling position or area of image based on a change of contents of image, according to various embodiments.

FIG. 2 is a block diagram 200 illustrating the display device 160, controlling position or area of image based on a change of contents of image, according to various embodiments. Referring to FIG. 2, the display device 160 may include a display 210 and a display driver integrated circuit (DDI) 230 to control the display 210. The DDI 230 may include an interface module 231, memory 233 (e.g., buffer memory), an image processing module 235, or a mapping module 237. The DDI 230 may receive image information that contains image data or an image control signal corresponding to a command to control the image data from another component of the electronic device 101 via the interface module 231. For example, according to an embodiment, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 150 or the sensor module 176 via the interface module 231. The DDI 230 may also store at least part of the received image information in the memory 233, for example, on a frame by frame basis. The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210. The mapping module 237 may generate a voltage value or a current value corresponding to the image data pre-processed or post-processed by the image processing module 235. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 210 may be driven, for example, based at least in part on the voltage value or the current value such that visual information (e.g., a text, an image, or an icon) corresponding to the image data may be displayed via the display 210.

According to an embodiment, the display device 160 may further include the touch circuitry 250. The touch circuitry 250 may include a touch sensor 251 and a touch sensor IC 253 to control the touch sensor 251. The touch sensor IC 253 may control the touch sensor 251 to sense a touch input or a hovering input with respect to a certain position on the display 210. To achieve this, for example, the touch sensor 251 may detect (e.g., measure) a change in a signal (e.g., a voltage, a quantity of light, a resistance, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 150)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

Figure 3:
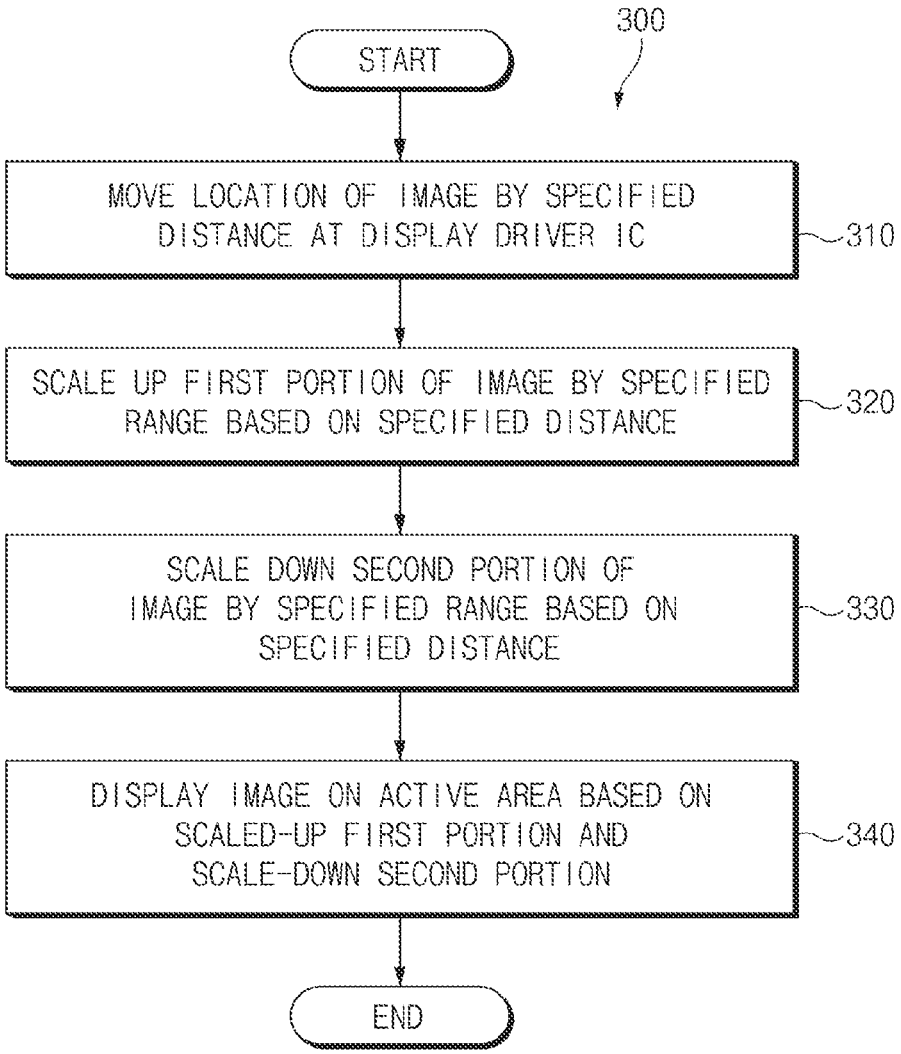
FIG. 3 is a flowchart illustrating a driving method of an electronic device according to an embodiment.

FIG. 3 is a flowchart 300 illustrating a driving method of an electronic device 101 according to an embodiment.

In operation 310, the electronic device 101 according to an embodiment may move a display location of one or more pixel data corresponding to an image associated with an application by a specified distance by using a display driver IC 230. A display 210 may include an active area (A/A) displaying an image. An image associated with at least one application may be displayed on the active area of the display 210. The image associated with the application may display information (e.g., a running screen) associated with a running or operation state of the corresponding application. When the application operates according to an input of a user or over the flow of time, the image associated with the application may display the changed state of the application and information to be indicated by the application. When a plurality of applications are running, the image associated with the application may be a running screen of the application, which is being input by the user, or an operation screen of an activated application.

In an embodiment, the image may be displayed using one or more pixels. One or more pixels arranged on the display 210 may operate based on pixel data. The display 210 may display an image having a specified luminance or a specified color based on pixel data. For example, the display 210 may receive pixel data displaying the image associated with the application and may display the image corresponding to the received pixel data.

In an embodiment, the display driver IC 230 may change a display location of one or more pixel data based on a specified rule on the active area. For example, the display driver IC 230 may change a location of the image at a specified time interval on the active area.

In an embodiment, the location of the image may move from any point by a specified distance. The any point may be set to coordinates. The any point may be represented as a distinguishing point on the display 210. For example, the location of the image may set a top-left vertex of the running screen to a reference point to represent the top-left vertex as origin coordinates. The top-left vertex may be located at a first point before moving and may move by a specified distance to move to a second point. The specified distance may be a length required to prevent degradation generated when the image is maintained for a long time. For example, the specified length may correspond to a length where a number of pixels to the point of being invisible to a user are arranged.

In an embodiment, the display driver IC 230 may specify a length in which any area moves. The display driver IC 230 may analyze content making up an image displayed on the display 210. For example, the display driver IC 230 may analyze parameters such as a luminance or a color of the content. The display driver IC 230 may analyze a degradation degree generated as the display 210 displays the content. The display driver IC 230 may specify a distance moved according to the degradation degree generated by the content. The display driver IC 230 may specify a distance where each area moves depending on content displayed on any area of the display 210.

In operation 320, the electronic device 101 according to an embodiment may scale up a first portion of the image by a specified range based on the specified distance. A processor 120 of the electronic device 101 may scale up at least a portion of a portion where the image is displayed to fill a portion changed to an empty space because the image is not displayed on the display 210 as the display location of the one or more pixel data moves by the specified distance. For example, the processor 120 may increase an area of a portion adjacent to the portion changed to the empty space. The processor 120 may scale up the portion adjacent to the portion changed to the empty space in the image to fill the empty space.

In operation 330, the electronic device 101 according to an embodiment may scale down a second portion of the image by the specified range based on the specified distance. The processor 120 of the electronic device 101 may scale down at least a portion of the portion where the image is displayed to prevent a portion, departing from the display 210, where the image is cropped, as the display location of the one or more pixel data moves by the specified distance. For example, the processor 120 may decrease an area of a portion adjacent to the portion departing from the display 210 in the image. The processor 120 may scale down the portion adjacent to the portion departing from the display 210 in the image such that the image is disposed in the display 210 without the cropped portion.

In operation 340, the electronic device 101 according to an embodiment may display the image on the active area based on the scaled-up first portion and the scaled-down second portion. Although the image having the scaled-up first portion and the scaled-down second portion moves by the specified length, it may be output without the empty portion or the cropped portion on the display 210.

Figure 4:
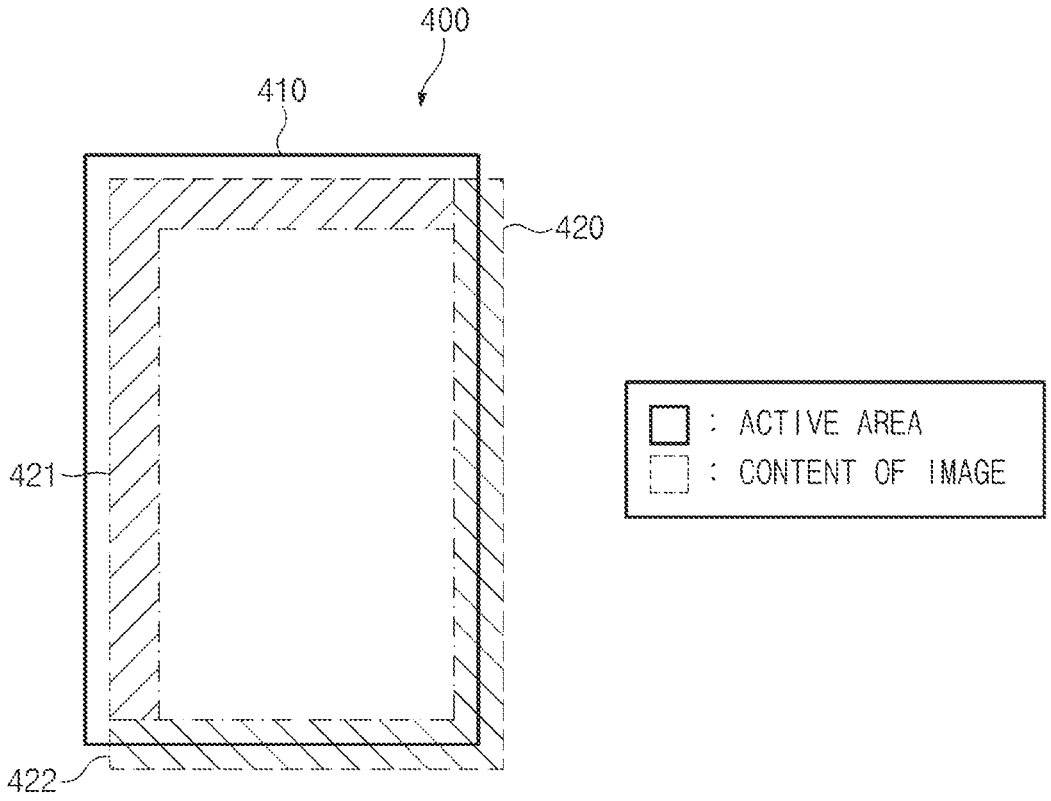
FIG. 4 is a drawing illustrating that an electronic device moves a display location of one or more pixel data corresponding to an image associated with an application according to an embodiment.

FIG. 4 is a drawing illustrating that an electronic device 101 moves an image 410 of an application according to an embodiment.

In an embodiment, a display driver IC 230 of an electronic device 101 may display an image 410 associated with an application on a display 210. The display driver IC 230 may move a display location of one or more pixel data corresponding to the image 410 to prevent degradation of the display 210. The display driver IC 230 may move the display location of the pixel data by a specified distance at a specified time interval. The display driver IC 230 may move the display location of the pixel data in a predefined direction.

In an embodiment, after moving the display location of the pixel data, the moved image 420 may be displayed on the display 210. Comparing the same content with respect to the locations displaying the same content, the moved image 420 may have a distance difference with the image 410 by the specified distance. The moved image 420 may include a first portion 421 and a second portion 422.

In an embodiment, the first portion 421 may be disposed on an edge area of the moved image 420. The first portion 421 may be disposed at an opposite side of the direction where the display location of the pixel data moves. For example, when the display location of the pixel data moves to the bottom right to display the moved image 420, the first portion 421 may be disposed on the top left of the moved image 420.

In an embodiment, the second portion 422 may be disposed on an edge area of the moved running screen 420. The second portion 422 may be disposed in the direction where the display location of the pixel data moves. For example, when the display location of the pixel data moves to the bottom right to display the moved image 420, the first portion 421 may be disposed on the bottom right of the moved image 420.

In an embodiment, the image 410 before moving may display content making up the image on the active area which is an area displayed by the solid line. The moved image 420 may display content making up the image on a content area of the image, which is an area displayed by the dotted line.

Figure 5A:
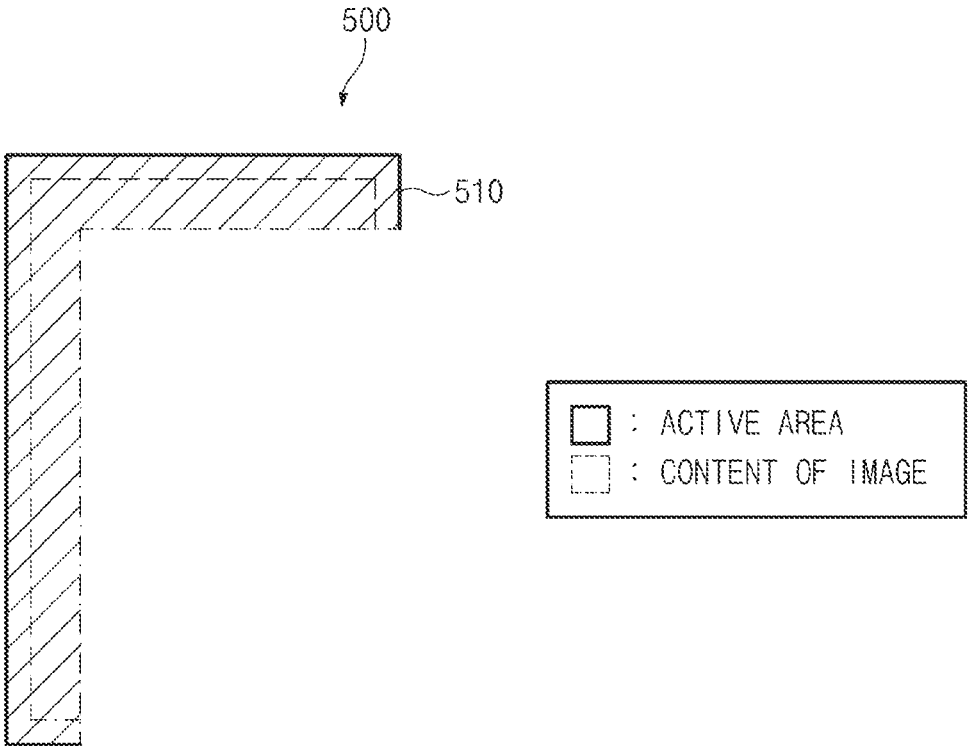
FIG. 5A is a drawing illustrating that an electronic device scales up an image according to an embodiment.

FIG. 5A is a drawing 500 illustrating that an electronic device 101 scales up an image according to an embodiment.

In an embodiment, a processor 120 of the electronic device 101 may scale up at least a portion of the image. The processor 120 may identify an empty space where the image is not displayed on an active area of a display 210. The processor 120 may scale up a first portion 510 of the image to remove the empty space of the display 210. The processor 120 may set a portion scaled up in the image to the first portion 510. For example, when an opposite side of the direction where the display location of the pixel data moves is scaled up, the processor 120 may set at least a portion of the opposite side of the direction where the display location of the pixel data moves to the first portion 510.

In an embodiment, up-scale may be performed in the first portion 510. When the up-scale is applied, an area of a portion displaying the same content may be scaled up such that distortion is not visible to a user. Pixel copy or pixel interpolation may be applied to apply the up-scale. When the pixel copy is applied, a pixel of an empty space may operate to the same as each of pixels displaying an image of an area adjacent to the empty space of the display 210. When the pixel interpolation is applied, pixels displaying the image of the area adjacent to the empty space of the display 210 may be set to a group for every a specified number of pixels. The processor 120 may set an average value of the pixels of the corresponding group to be displayed by a next pixel. In such a manner, the empty space of the display 210 may be filled while increasing the number of pixels displaying the same content on the first portion 510.

In an embodiment, the processor 120 of the electronic device 101 may scale up the first portion 510 to fill an empty portion on the active area of the display 210 as the display location of the pixel data moves. The processor 120 may scale up the first portion 510 to a border of the active area. For example, the processor 120 may be configured to scale up and display content displayed on a content area of the image displayed on the first portion 510 by the dotted line when not scaled up the border of the active area.

Figure 5B:
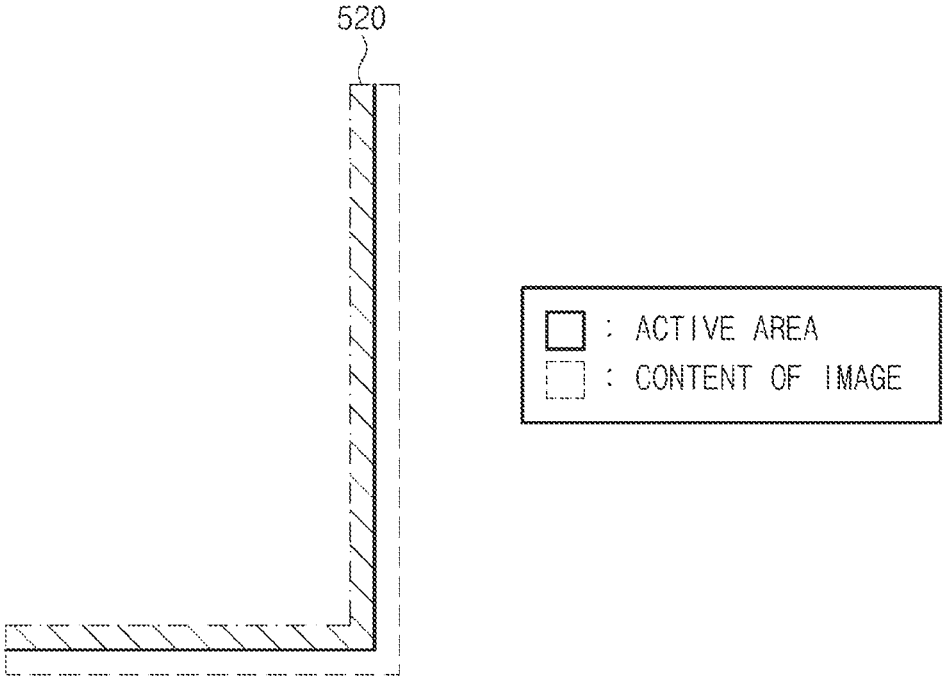
FIG. 5B is a drawing illustrating that an electronic device scales down an image according to an embodiment.

FIG. 5B is a drawing illustrating that an electronic device 101 scales down an image according to an embodiment.

In an embodiment, a processor 120 of the electronic device 101 may scale down at least a portion of the image. The processor 120 may identify a portion where the image departs from the active area of the display 210 to be cropped. The processor 120 may scale down a second portion 520 of the image to remove the portion where the image is cropped. The processor 120 may set a portion scaled down in the image to the second portion 520. For example, when the direction where the display location of the pixel data moves is scaled down, the processor 120 may set at least a portion of the direction where the display location of the pixel data to the second portion 520.

In an embodiment, down-scale may be performed in the second portion 520. When the down-scale is applied, an area of a portion displaying the same content may be scaled down such that distortion is not visible to a user. Pixel truncation may be applied to apply the down-scale. When the pixel truncation is applied, pixels displaying an image of an area adjacent to an empty space of the display 210 may be set to a group for every a specified number of pixels. The processor 120 may configured to delete any one of pixels of the corresponding group. In such a manner, the image departing from the display 210 may be scaled down while reducing the number of pixels displaying the same content on the second portion 520.

In an embodiment, the processor 120 of the electronic device 101 may scale down the second portion 520 to remove a portion cropped on the active area of the display 210 as the display location of the pixel data moves. The processor 120 may scale down the first portion 520 to a border of the active area. For example, the processor 120 may configured to scale down and display content displayed on a content area of the image displayed on the second portion 520 by the dotted line when not scaled down to the border of the active area.

Figure 6:
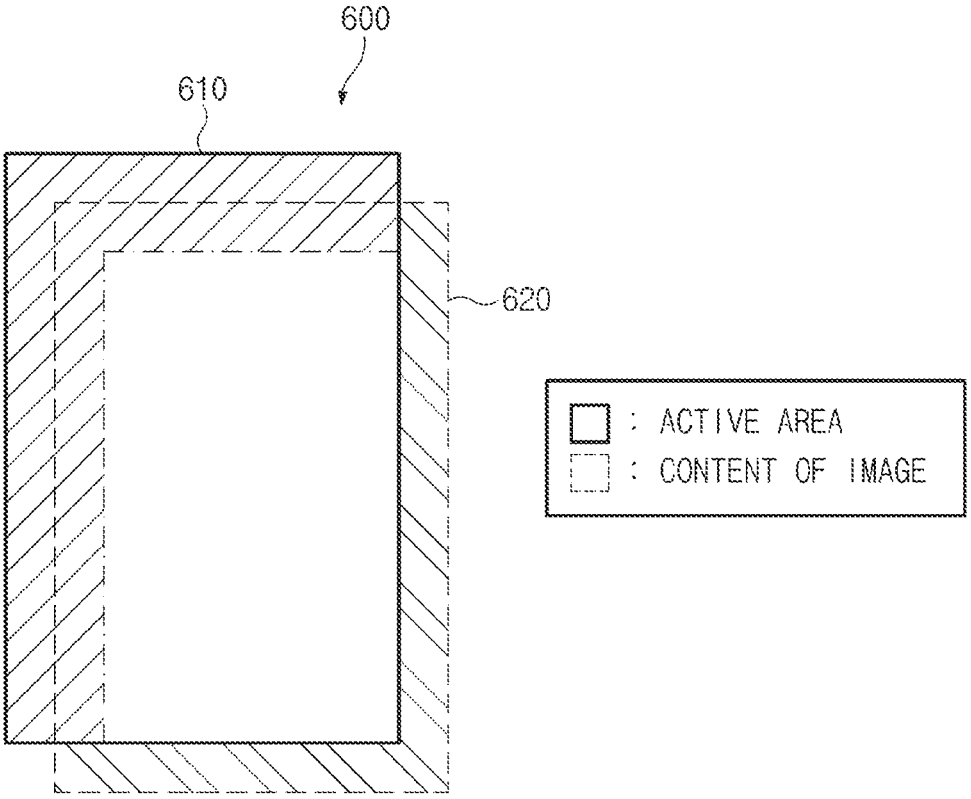
FIG. 6 is a drawing illustrating that an electronic device scales up and crops content making up all of an image according to an embodiment.

FIG. 6 is a drawing 600 illustrating that an electronic device 101 scales up and crops content making up all of an image according to an embodiment.

In an embodiment, a display driver IC 230 may move content of the image in the direction of bottom right. The content of the image may move to the bottom right compared with an active area. An empty area where pixel data does not display content may occur on a top-left area of the active area. At least a portion of content to be displayed by pixel data may move on to outside the active area on a bottom-right area of the active area and may not be displayed on the active area to be cropped.

In an embodiment, the processor 120 may set at least a portion of an opposite side of the direction where the display location of the pixel data moves to a first portion 610 and may set at least a portion of the direction where the display location of the pixel data moves to a second portion 620. For example, the processor 120 may set a top-left area, which is an opposite side of the direction where the content of the image moves, to the first portion 610 and may set a bottom-right area, which is the direction where the content of the image moves, to the second portion 620.

In an embodiment, the processor 120 of the electronic device 101 may apply up-scale to the first portion 610 of the content of the image to scale up the first portion 610. The processor 120 may scale up an empty portion to be filled on the active area. The processor 120 may scale up the content of the image displayed on the first portion 610 to a border of the active area. For example, the processor 120 may configured to scale up and display content displayed on a content area of the image displayed on the first portion 610 by the dotted line when not scaled up to the border of the active area.

In an embodiment, the processor 120 of the electronic device 101 may be configured to maintain the second portion 620 of the content of the image without change without scaling up or down the second portion 620. The processor 120 may display the content of the image displayed on the second portion 620 in the same manner as that before moving. The processor 120 may be configured to crop a portion moving on outside of the active area in the content of the image. The processor 120 may fail to display the portion moving on outside of the active area in the content of the image. For example, when it is determined to display content where it does not matter when a partial area is cropped, for example, when the same color or the same pattern is repeated on the second portion 620, the processor 120 may maintain content, displayed on a content area of the image displayed on the second portion 620 by the dotted line when not scaled down, in a state where it is outside the active area, to fail to display the content.

Figure 7:
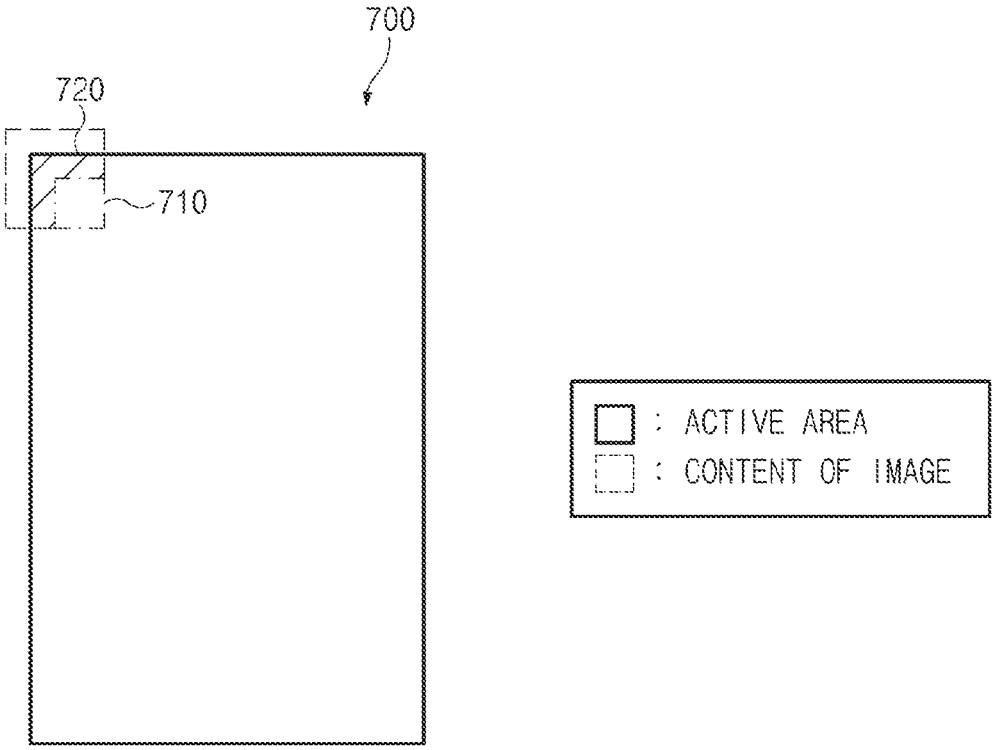
FIG. 7 is a drawing illustrating that an electronic device scales down content making up a portion of an image according to an embodiment.

FIG. 7 is a drawing 700 illustrating that an electronic device scales down content making up a portion of an image according to an embodiment.

In an embodiment, a display driver IC 230 may move content making up a portion of the image. In this case, only some content of the image may move from the active area, and the other content may maintain its fixed location on the active area. The display driver IC 230 may move only content where it is easy to generate degradation on the display 210 from the active area. For example, the display driver IC 230 may move only a location of specific content, such as a button maintaining a fixed shape and color, in a state where a location of background image content displaying a background changed in real time in the image is fixed.

In an embodiment, the display driver IC 230 may move content making up a portion of the image to outside the active area. At least a portion of content to be displayed by pixel data may move on to outside the active area on a top-left area of the active area and may not be displayed on the active area to be cropped.

In an embodiment, the processor 120 may set at least a portion of an opposite side of the direction where a display location of pixel data moves to a first portion 710 and may set at least a portion of the direction where the display location of the pixel data moves to a second portion 720. For example, the processor 120 may set a bottom-right portion of a content area of the image to the first portion 710 and may set a top-left area of the content area of the image to the second portion 720.

In an embodiment, the processor 120 of an electronic device 101 may be configured to maintain the first portion 710 of the content of the image without change without scaling up or down the first portion 710. The processor 120 may display the content of the image displayed on the first portion 710 in the same manner as that before moving.

In an embodiment, the processor 120 may apply down-scale to the second portion 720 of the content of the image to scale down the second portion 720. The processor 120 may scale down the second portion 720 such that a cropped portion does not occur in the content of the image. The processor 120 may scale down the second portion 720 to remove a portion cropped on the active area as the display location of the pixel data moves. The processor 120 may scale down the second portion 720 to a border of the active area. For example, the processor 120 may be configured to scale down and display content displayed on a content area of the image displayed on the second portion 720 by the dotted line when not scaled down to the border of the active area.

Figure 8:
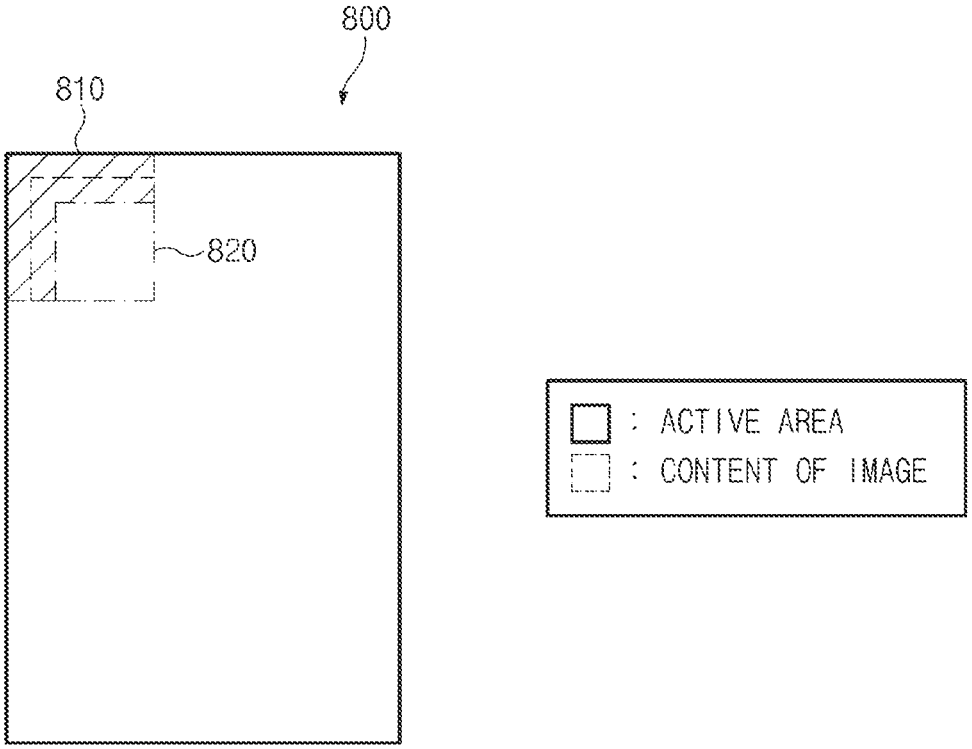
FIG. 8 is a drawing illustrating that an electronic device scales up content making up a portion of an image according to an embodiment.

FIG. 8 is a drawing illustrating that an electronic device scales up content making up a portion of an image according to an embodiment.

In an embodiment, a display driver IC 230 may move content making up a portion of the image to inside an active area. An empty area where pixel data does not display content may occur on a top-left area of the display area.

In an embodiment, a processor 120 may set at least a portion of an opposite side of the direction where a display location of pixel data moves to a first portion 810 and may set at least a portion of the direction where the display location of the pixel data moves to a second portion 820. For example, the processor 120 may set a top-left portion of a content area of the image to the first portion 810 and may set a bottom-right area of the content area of the image to the second portion 820.

In an embodiment, the processor 120 may apply up-scale to the first portion 810 of the content of the image to scale up the first portion 810. The processor 120 may scale up the first portion 810 such that a cropped portion does not occur on the active area. The processor 120 may scale up the first portion 810 such that the empty area according to movement of the display location of the pixel data does not occur on the active area. The processor 120 may scale up the first portion 810 to a border of the active area. For example, the processor 120 may be configured to scale up and display content displayed on a content area of the image displayed on the first portion 810 by the dotted line when not scaled down to the border of the active area.

In an embodiment, the processor 120 of an electronic device 101 may be configured to maintain the second portion 820 of the content of the image without change without scaling up or down the second portion 820. The processor 120 may display the content of the image displayed on the second portion 820 in the same manner as that before moving.

Figure 9:
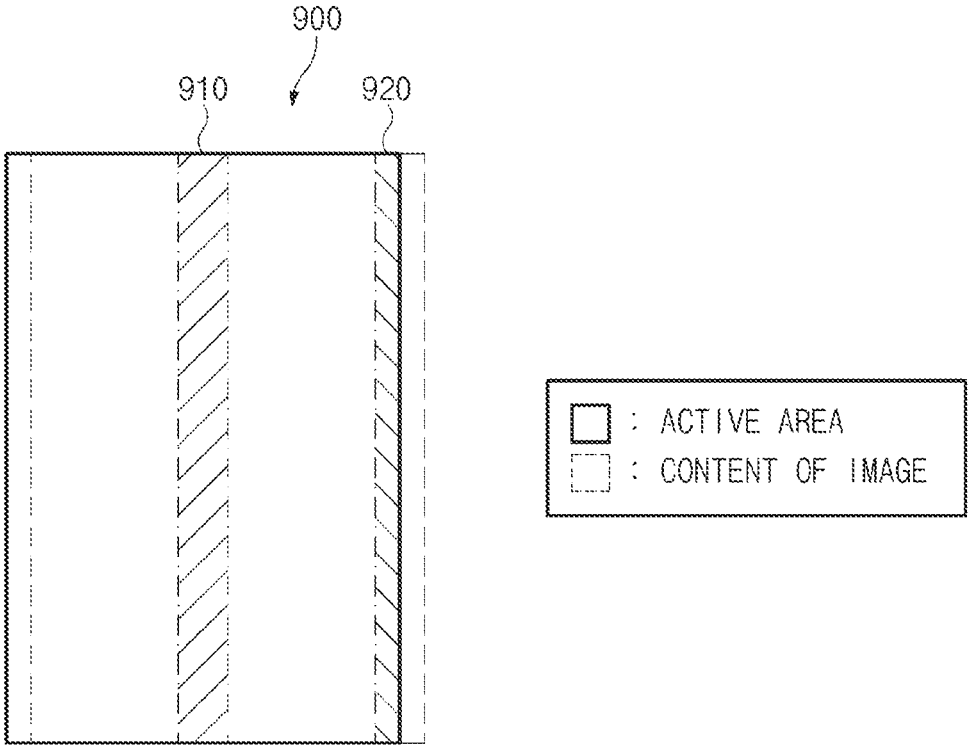
FIG. 9 is a drawing illustrating that an electronic device scales up and down an image according to another embodiment.

FIG. 9 is a drawing 900 illustrating that an electronic device 101 scales up and down an image according to another embodiment.

In an embodiment, a processor 120 of the electronic device 101 may scale up a first portion 910 of the image to remove an empty space of an active area of a display 210. To scale up an image to an opposite side of the direction where a display location of pixel data moves, the processor 120 may set at least a portion of a central portion of the image to a first portion 910. For example, when the display location of the pixel data moves to the right, the processor 120 may apply up-scale to the first portion 910 set to the central portion to scale up the image to the left. The processor 120 may scale up the image to a border of the active area of the display 210.

In an embodiment, the processor 120 of the electronic device 101 may scale down a second portion 920 of the image to remove a cropped space of the image. To scale down the image in the direction where the display location of the pixel data moves, the processor 120 may set an edge portion disposed in the direction to the second portion 920. For example, when the display location of the pixel data moves to the right, the processor 120 may specify a right edge area to the second area 920. The processor 120 may apply down-scale to the second portion 920 to scale down the image. The processor 120 may scale down the image to a border of the active area of the display 210.

Figure 10:
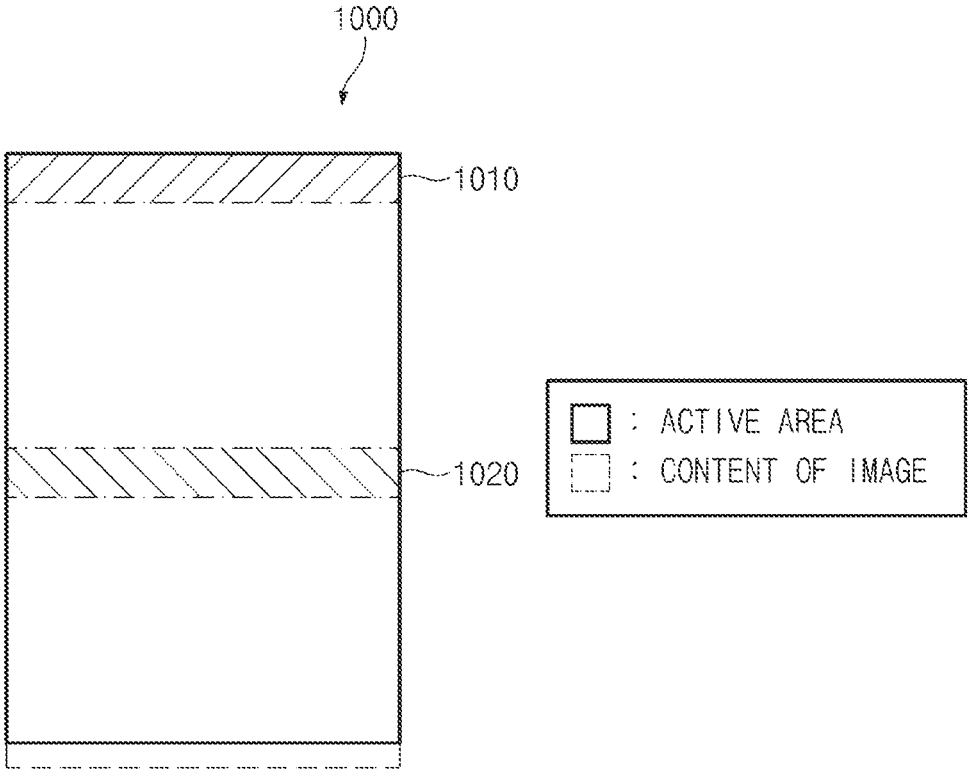
FIG. 10 is a drawing illustrating that an electronic device scales up and down an image according to another embodiment.

FIG. 10 is a drawing 1000 illustrating that an electronic device 101 scales up and down an image according to another embodiment.

In an embodiment, a processor 120 of the electronic device 101 may scale up a first portion 1010 of the image to remove an empty space of an active area of a display 210. To scale up the image to an opposite side of the direction where a display location of pixel data moves, the processor 120 may set an edge portion disposed at the opposite side of the direction to the first portion 1010. For example, when the display location of the pixel data moves to the bottom, the processor 120 may specify a top edge area to the first portion 1010. The processor 120 may apply up-scale to the first portion 1010 to scale up the image to the top. The processor 120 may scale up the image to a border of the active area of the display 210.

In an embodiment, the processor 120 of the electronic device 101 may scale down a second portion 1020 of the image to remove a cropped portion of the image. To scale down the image in the direction where the display location of the pixel data moves, the processor 120 may set at least a portion of a central portion to the second portion 1020. For example, when the display location of the pixel data moves to the bottom, the processor 120 may apply down-scale to the second portion 1020 to scale down the image. The processor 120 may scale down the image to a border of the active area of the display 210.

Figure 11:
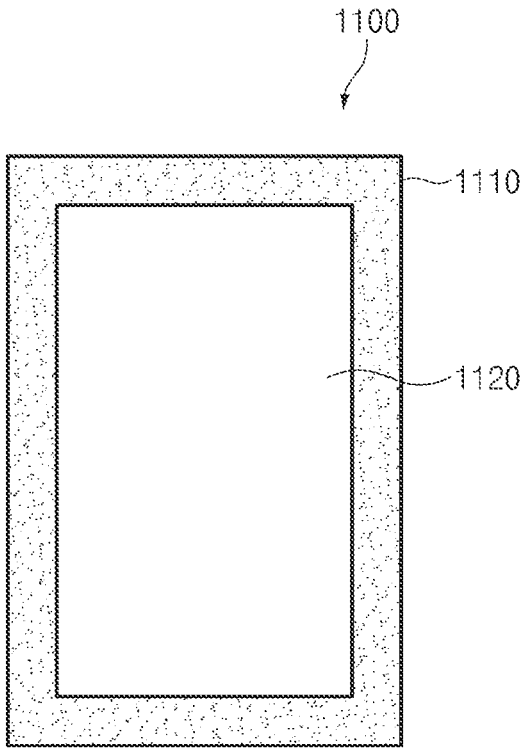
FIG. 11 is a drawing illustrating that an electronic device displays an image in three dimensions according to an embodiment.

FIG. 11 is a drawing 1100 illustrating that an electronic device 101 displays an image in three dimensions according to an embodiment.

In an embodiment, a display driver IC 230 of the electronic device 101 may be configured to, when a display location of pixel data moves, represent an edge portion 1110 adjacent to a border of a display 210 in the image in three dimensions. When the display location of the pixel data moves, the display driver IC 230 may display content in three dimensions by assigning a three-dimensional effect at the same time as changing an area of the content displayed on the edge portion 1110 of the image.

In an embodiment, the display driver IC 230 may be configured to perform stereoscopic effect processing, such as a ripple effect or a three-dimensional effect, on the edge portion 1110 such that a user views a running screen like a three-dimensional screen. The display driver IC 230 may be configured to change data in software such that the edge portion 1110 of the image is visible like a three-dimensional screen, or may be configured such that the edge portion 1110 of the image is visible like the three-dimensional screen using a physical structure of the electronic device 101. For example, the display driver IC 230 may be configured to, when the edge portion 1110 of the display 210 is formed as a curved surface unlike a central portion 1120, assign a sense of flexion while changing an area of content when a display location of pixel data moves such that the user views the image like the three-dimensional screen.

Figure 12:
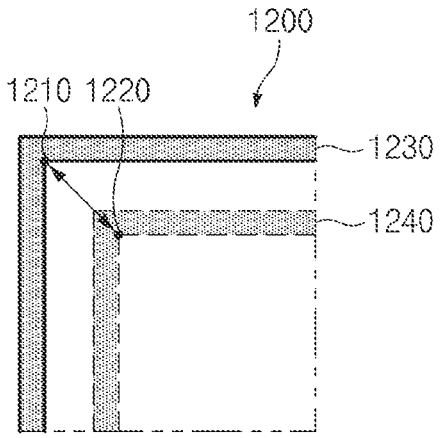
FIG. 12 is a drawing illustrating that an electronic device moves an image having a masking portion according to an embodiment.

FIG. 12 is a drawing 1200 illustrating that an electronic device 101 moves an image having making portions 1230 and 1240 according to an embodiment.

In an embodiment, a display driver IC 230 of the electronic device 101 may move an image. For example, the display driver IC 230 may move the image by a specified distance with respect to a predefined point 1210 which is one of vertices of the image to move the predetermined point 1210 to a moved point 1220.

In an embodiment, the display driver IC 230 may generate the masking portion 1230 hiding an image of an edge portion adjacent a border of the display 210 in the image. The masking portion 1230 may be disposed to surround an active area in a bezel disposed on a border of the display 210. The masking portion 1230 may be disposed to surround vertices and corners including the predefined point 1210. Pixels displaying the masking portion 1230 may operate with a predefined gray scale (e.g., a black gray scale) such that the image is not visible.

In an embodiment, when the location of the image moves, the masking portion 1230 may move by a specified distance in the same direction as the direction where a display location of pixel data moves. When the display location of the pixel data moves, a moved masking portion 1240 may be disposed to surround vertices and corners including the moved point 1220 with respect to the moved point 1220. For another example, when the location of the image moves, the masking portion 1230 may be scaled up by the specified distance in the same direction as the direction where the display location of the pixel data moves. In this case, the masking portion 1230 may increase in area to include all from an originally occupied area to a portion 1240 surrounding vertices and corners including the moved point 1220 with respect to the moved point 1220.

Figure 13:
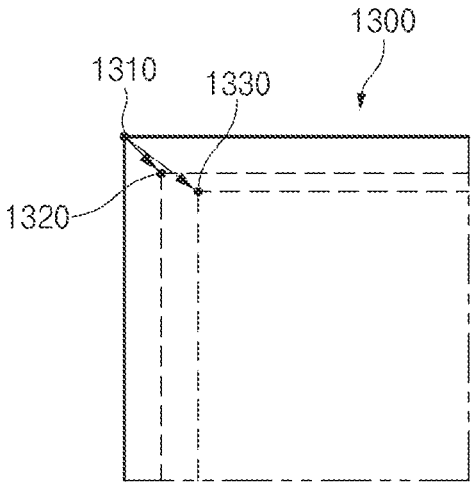
FIG. 13 is a drawing illustrating that an electronic device moves a location of an image according to another embodiment.

FIG. 13 is a drawing 1300 illustrating that an electronic device 101 moves a location of an image according to another embodiment.

In an embodiment, a display driver IC 230 of the electronic device 101 may change movement strength and a jumping area of content of the image depending on a driving condition of a display 210. In the disclosure, the movement strength of the content of the image may be referred to as a time interval moving a location of the image. Furthermore, in the disclosure, the jump area of the content of the image may be referred to as a specified distance moving the location of the image. The more the risk that degradation will occur increases on the display 210, the more the display driver IC 230 may increase the movement strength and the jump area of the content. The risk that the degradation will occur may be calculated based on a luminance of the image, a temperature of the electronic device 101, or color strength of the image.

In an embodiment, the display driver IC 230 of the electronic device 101 may move a location of the image at a specified time interval. The specified time interval may be set according to a luminance of the image, a temperature of the electronic device 101, or color strength of the image. For example, when the luminance of the image increases to a specified luminance or more (e.g., a standard luminance of 183 nit or more), the display driver IC 230 may reduce a period when the image moves (e.g., reduce 60 seconds to 40 seconds). As another example, when the luminance of the image decreases to another specified luminance or less (e.g., low luminance of 60 nit or less), the display driver IC 230 may increase the period when the image moves (e.g., increase 60 seconds to 90 seconds).

In an embodiment, the display driver IC 230 of the electronic device 101 may move a location of the image by a specified distance. The specified distance may be proportional to a degree of risk that degradation will occur. For example, the specified distance may be set according to a luminance of the image, a temperature of the electronic device 101, or color strength of the image.

In an embodiment, the display driver IC 230 of the electronic device 101 may move an image 1310 by a specified distance and may display moved images 1320 and 1330. For example, when the luminance of the image increases to a specified luminance or more, the display driver IC 230 may increase a distance where the image moves (e.g., increase a width of two pixels to a width of three pixels) and may display the moved image 1330. For another example, when the luminance of the image decreases to another specified luminance or less, the display driver IC 230 may decrease a distance where the image moves (e.g., decrease a width of two pixels to a width of one pixel) and may display the moved image 1320.

Figure 14:
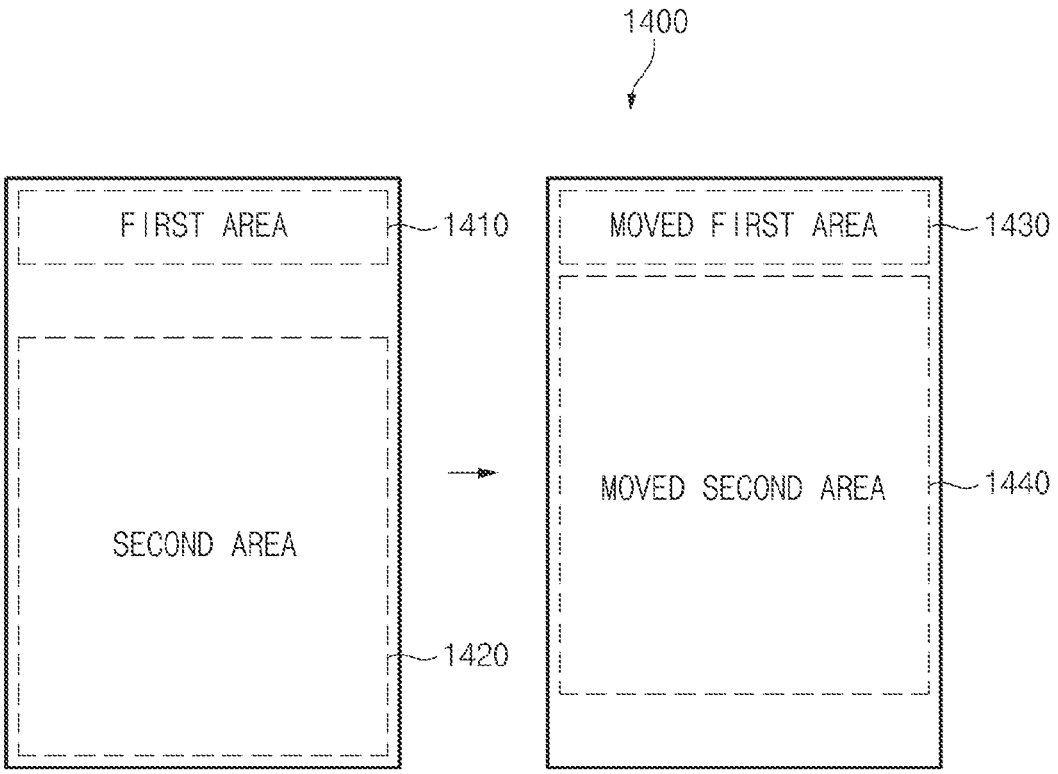
FIG. 14 is a drawing illustrating that an electronic device moves a location of an image according to another embodiment.

FIG. 14 is a drawing 1400 illustrating that an electronic device 101 moves a location of an image according to another embodiment.

In an embodiment, a display driver IC 230 of the electronic device 101 may divide an image into a plurality of areas including a first area 1410 and a second area 1420. The first area 1410 and the second area 1420 may be arranged at different locations of the image. The first area 1410 and the second area 1420 may display different content. The first area 1410 and the second area 1420 may have different areas, luminance, temperature, color strength, or the amount of change of displayed content. The first area 1410 and the second area 1420 may have different degrees to which degradation occurs.

In an embodiment, a processor 120 of the electronic device 101 may move a location of the first area 1410 by a first distance and may move a location of the second area 1420 by a second distance. After the first area 1410 moves by the first distance, content displayed on the first area 1410 may be displayed on a moved first area 1430. After the second area moves by the second distance, content displayed on the second area 1420 may be displayed on a moved second area 1440. The first distance or the second distance may be set based on conditions, such as an area of the first area 1410 or the second area 1420, an area around the first area 1410 or the second area 1420, or a risk of degradation in the first area 1410 or the second area 1420. For example, when the area of the first area 1410 is small and when displaying content of low luminance, the processor 120 may set the first distance to be shorter than the second distance.

In an embodiment, the processor 120 of the electronic device 101 may be configured to display the image on an active area based on the moved first area 1430 and the moved second area 1440. The processor 120 may move the first area 1410 or the second area 1420 to change the location to the moved first area 1430 or the moved second area 1440 and may display the image. The processor 120 may scale up or down an area except for the first area 1410 or the second area 1420 to prevent an empty space or a cropped portion capable of occurring due to the movement and may display the image on the active area.

Figure 15:
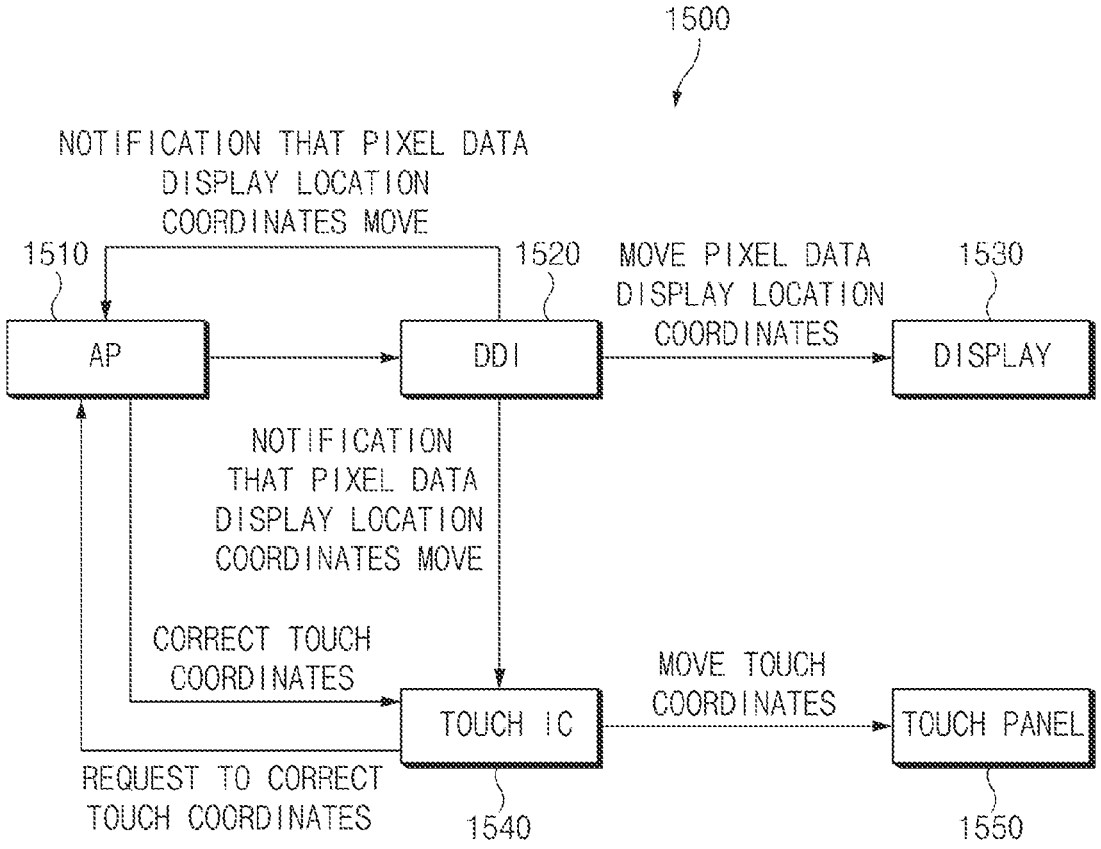
FIG. 15 is a block diagram illustrating that an electronic device corrects touch coordinates as moving coordinates of an image according to an embodiment.

FIG. 15 is a block diagram 1500 illustrating that an electronic device 101 corrects touch coordinates as moving coordinates of an image according to an embodiment. In FIG. 15, an AP 1510 may be substantially the same as a processor 120, and a DDI 1520 may be substantially the same as a display driver IC 230. Furthermore, in FIG. 12, a display 1530 may be the same component as a display 210, and a touch IC 1540 may be the same component as a touch sensor IC 253. Furthermore, in FIG. 15, a touch panel 1550 may be disposed on the display 1530 and may include a touch sensor 251 to detect a touch of a user.

In an embodiment, the AP 1510 may control the DDI 1520 and may deliver pixel data display location coordinates capable of displaying an image of an application to the DDI 1520.

In an embodiment, the DDI 1520 may display an image on the display 1530 using image data obtained from the AP 1510. When displaying the image, the DDI 1520 may move pixel data display location coordinates on the display 1530 to prevent degradation. For example, the DDI 1520 may move the image at a specified time interval by a specified distance. In this case, vertices of the image may move by the amount of change in the specified coordinates.

In an embodiment, the DDI 1520 may notify the AP 1510 and the touch IC 1540 that the coordinates of the image move. The DDI 1520 may deliver information associated with a time when the coordinates of the image move and the amount of change in the coordinates to the AP 1510 and the touch IC 1540.

In an embodiment, the touch IC 1540 may receive information providing the notification that pixel data display location coordinates move from the DDI 1520. When receiving the information providing the notification that the pixel data display location coordinates move, because the image moves, the touch IC 1540 may detect that touch coordinates, which are a location where a user touches content, should be corrected to correspond to the moved image. The touch IC 1540 may request the AP 1510 to correct the touch coordinates.

In an embodiment, the AP 1510 may receive the information providing the notification that the pixel data display location coordinates move from the DDI 1520 and may receive a request to correct the touch coordinates from the touch IC 1540. The AP 1510 may correct the touch coordinates based on the amount of change in the pixel data display location coordinates. For example, the AP 1510 may move touch coordinates to correspond to the amount of change in the pixel data display location coordinates and apply the same touch coordinates to the same content.

In an embodiment, the AP 1510 may correct and deliver the touch coordinates to the touch IC 1540. The AP 1510 may correspond and input the corrected touch coordinates one to one to the touch IC 1540.

In an embodiment, the touch IC 1540 may notify the touch panel 1550 that the touch coordinates move. The touch IC 1540 may be configured to detect a touch of the user in response to the touch coordinates moved by the touch sensor 251 of the touch panel 1550.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd", or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

What is claimed is:

1. An electronic device, comprising:

a display;

a display driver integrated circuit (IC) configured to drive the display; and at least one processor operationally connected with the display and the display driver IC, wherein the display driver IC is configured to move a display location of one or more pixel data corresponding to an image associated with at least one application from a specified point by a specified distance on an active area of the display, and wherein the at least one processor is configured to:

scale up a first portion of the image to a border of the active area to fill a portion on the active area generated by moving the display location of the pixel data to reduce degradation generated when the image is maintained for a predetermined time, wherein the scale up of the first portion of the image comprises increasing a number of pixels for displaying the first portion of the image; and display the image on the active area based on the scaled-up first portion.

2. The electronic device of claim 1, wherein the at least one processor is configured to:

scale down a second portion of the image to a border of the active area to remove a cropped portion of the image on the active area as the display location of the pixel data moves to reduce the degradation generated when the image is maintained for the predetermined time, wherein the scale down of the second portion of the image comprises reducing a number of pixels for displaying the second portion of the image; and wherein the at least one processor is further configured to:

display the image on the active area based on the scaled-up first portion and the scaled-down second portion.

3. The electronic device of claim 2, wherein the at least one processor is configured to:

specify at least a portion of an opposite side of a direction in which the display location of the pixel data moves as the first portion; and specify at least a portion of the direction in which the display location of the pixel data moves as the second portion.

4. The electronic device of claim 2, wherein the at least one processor is configured to:

perform the scale up by applying pixel copy or pixel interpolation on the first portion; and perform the scale down by applying pixel truncation on the second portion.

5. The electronic device of claim 1, wherein the display driver IC is configured to:

represent an edge portion adjacent to a border of the display in the image in three dimensions upon the movement.

6. The electronic device of claim 1, wherein the specified distance is set based on at least one of a luminance of the image, a temperature of the electronic device, or color strength of the image.

7. The electronic device of claim 1, wherein the display driver IC is configured to:

divide the image into a plurality of areas including a first area and a second area;

move a display location of pixel data of the first area by a first distance;

move a display location of pixel data of the second area by a second distance; and display the image on the active area based on the moved first area and the moved second area.

8. An electronic device, comprising:

a display;

a display driver integrated circuit (IC) configured to drive the display; and at least one processor operationally connected with the display and the display driver IC, wherein the display driver IC is configured to move a display location of one or more pixel data corresponding to an image associated with at least one application depending on a plurality of parameters by a specified distance on an active area of the display, and wherein the at least one processor is configured to:

scale up a first portion of the image to a border of the active area to fill a portion on the active area as the display location of the pixel data moves to reduce degradation generated when the image is maintained for a predetermined time, wherein the scale up of the first portion of the image comprises increasing a number of pixels for displaying the first portion of the image; and display the image on the active area based on the scaled-up first portion.

9. The electronic device of claim 8, wherein the at least one processor is configured to:

scale down a second portion of the image to a border of the active area to remove a cropped portion of the image on the active area as the display location of the pixel data moves to reduce the degradation generated when the image is maintained for the predetermined time, wherein the scale down of the second portion of the image comprises reducing a number of pixels for displaying the second portion of the image;

wherein the at least one processor is further configured to:

display the image on the active area based on the scaled-up first portion and the scaled-down the second portion.

10. The electronic device of claim 9, wherein the at least one processor is configured to:

perform the scale up by applying pixel copy or pixel interpolation on the first portion; and perform the scale down by applying area truncation or pixel deletion on the second portion.

11. The electronic device of claim 9, wherein the display driver IC is configured to:

represent an edge portion adjacent to a border of the display in a running screen in three dimensions upon the movement.

12. The electronic device of claim 8, wherein the plurality of parameters include a luminance of the image, a temperature of the electronic device, or color strength of the image.

13. The electronic device of claim 8, wherein the display driver IC is configured to:

divide the image into a plurality of areas including a first area and a second area;

move a display location of pixel data of the first area by a first distance;

move a display location of pixel data of the second area by a second distance; and display the image on the active area based on the moved first area and the moved second area.

14. A non-transitory computer-readable storage medium storing instructions which, when executed by at least one processor of an electronic device comprising a display driver IC configured to move a display location of one or more pixel data corresponding to an image from a specified point by a specified distance on an active area of the display, configure the at least one processor to control the electronic device to perform operations comprising:

scaling up a first portion of the image to a border of the active area to fill a portion on the active area as the display location of the pixel data moves to reduce degradation generated when the image is maintained for a predetermined time, wherein the scale up of the first portion of the image comprises increasing a number of pixels for displaying the first portion of the image; and displaying the image on the active area based on the scaled-up first portion.

15. The non-transitory computer-readable storage medium of claim 14, wherein the instructions configure the at least one processor to control the electronic device to perform operations comprising:

scaling down a second portion of the image to a border of the active area to remove a cropped portion of the image on the active area as the display location of the pixel data moves to reduce the degradation generated when the image is maintained for the predetermined time, wherein the scaling down of the second portion of the image comprises reducing a number of pixels for displaying the second portion of the image;

wherein the displaying the image includes displaying the image on the active area based on the scaled-up first portion and the scaled-down second portion.

* * * * *